United States Patent [19]

Kuhlen

[11] Patent Number: 4,940,397

[45] Date of Patent: Jul. 10, 1990

[54] FUEL PUMP HAVING A PRESSURE CHAMBER VENTED VIA A BALL VALVE TO THE FUEL TANK

[75] Inventor: Ernst Kuhlen, Willich, Fed. Rep. of Germany

[73] Assignee: Pierburg GmbH, Neuss, Fed. Rep. of Germany

[21] Appl. No.: 307,420

[22] Filed: Feb. 6, 1989

[30] Foreign Application Priority Data

Jun. 21, 1988 [DE] Fed. Rep. of Germany ..... 3820887

[51] Int. Cl.[5] ..... F04B 43/02

[52] U.S. Cl. ..... 417/435; 123/516; 417/306

[58] Field of Search ..... 417/435, 413, 395, 306; 123/516, 514

[56] References Cited

U.S. PATENT DOCUMENTS 3,212,449 10/1965 Whalen et al. ..... 417/435
4,625,694 2/1986 Adey et al. ..... 123/516
4,776,771 10/1988 Kern ..... 417/413

FOREIGN PATENT DOCUMENTS 0168656 0000 European Pat Office.
3724603 1/1988 Fed. Rep. of Germany .
2028921 0000 United Kingdom.

*Primary Examiner*—Leonard E. Smith
*Assistant Examiner*—Robert N. Blackmon
*Attorney, Agent, or Firm*—Ladas & Parry

[57] ABSTRACT

A fuel pump includes a connecting pipe having an open end disposed at the lowest point in a pressure chamber supplied with fuel by a pressure valve. The connecting pipe is connected to a mixture-former and the pressure chamber has in its upper region a ball valve with a return line which leads to a fuel tank. The pressure chamber can have a cavity establishing the lowest region thereof, the open end of the connecting size being disposed in the cavity. A filter can surround the lower end of the pipe to filter the fuel supplied thereto.

11 Claims, 1 Drawing Sheet

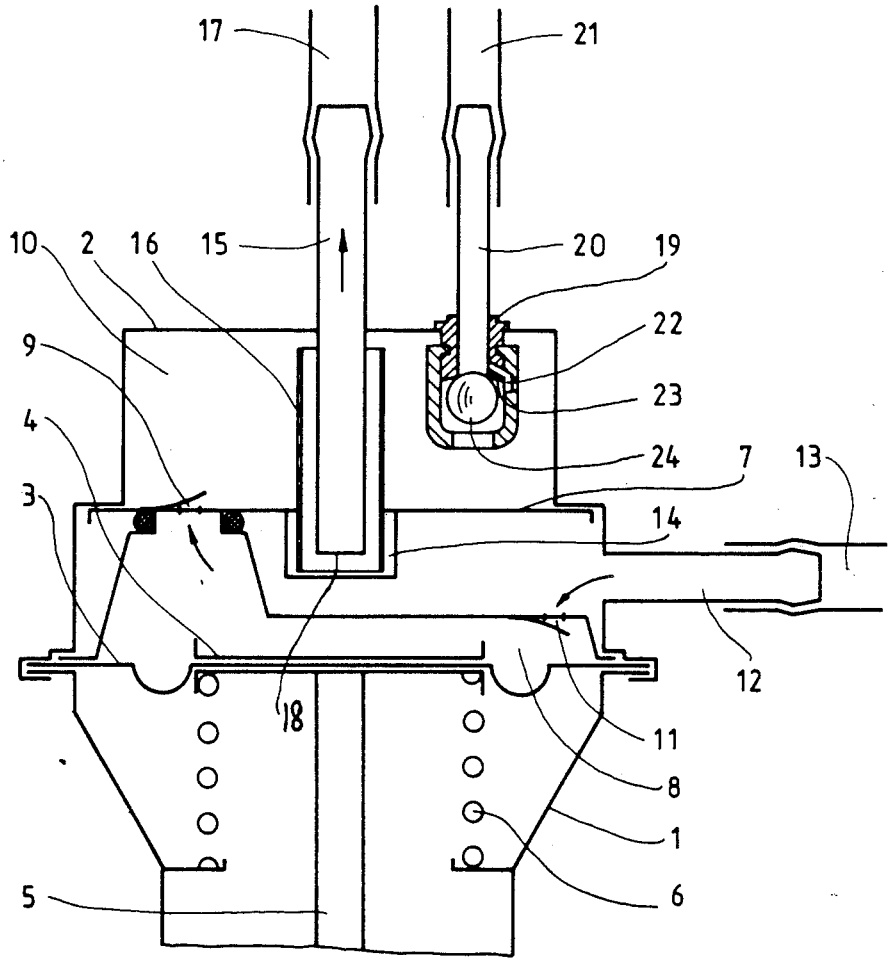
17
21
10
2
16
15
20
19
22
9
23
4
24
7
13
3
14
12
18
11
8
1
5
6

FUEL PUMP HAVING A PRESSURE CHAMBER VENTED VIA A BALL VALVE TO THE FUEL TANK

FIELD OF THE INVENTION

The present invention relates to a fuel pump, particularly a diaphragm-pump, which is driven by an internal combustion engine and can be attached directly thereto, the pump having a working chamber which is filled via a suction valve and emptied via a pressure valve.

DESCRIPTION OF PRIOR ART

Fuel pumps of the above type are characterized in that they take up little space and are therefore frequently used for supplying fuel to the carburetors of internal combustion engines which are installed in motor vehicles.

In this case, the fuel pump is directly attached to the engine housing and is thus subject to the variable temperature of the engine which is dependent on the state of operation of the engine. Considerable differences in temperature occur which are promoted by the small engine compartments of modern streamlined vehicles.

As a result of increase in the low-boiling fractions of fuel which has taken place in recent times, irregularity in driving during hot idling operation and difficulties in hot starting are frequently encountered, caused by vaporization of the fuel.

DE-OS 20 00 213 discloses two types of disturbances. One is the formation of a vapor lock within the pump and the other is the formation of a vapor lock in the lines connecting the pump to the mixture-former (carburetor or fuel injectors) of the internal combustion engine.

In DE-OS 20 00 213, a diaphragm is provided which is acted on by the pressure in the line and which throttles the cross sectional passage of the line leading to the mixture-former upon the occurrence of an increase in pressure caused by the formation of vapor and, at the same time, it opens a return channel from this line to the intake line. A similar proposal is found in DE-OS 25 59 157, which regulates the pressure present in the line between the pump and the mixture-former and, independently thereof, controls a return channel through which fuel and possibly also fuel vapor can flow back into the fuel tank.

It is furthermore known to provide between the fuel pump and the mixture-former a separate gas separator which can discharge a large amount of fuel vapor to the tank through an open ball-check valve and a return line and, after the discharge of the fuel vapor, permits only a small amount of liquid fuel to flow via a bypass (the ball valve then closing the large return cross section).

These gas separators, however, are expensive, require a separate type of attachment and, consequently, cannot by employed in all cases.

SUMMARY OF THE INVENTION

An object of the present invention is to provide an inexpensive fuel pump of this type by which error-free hot operation is possible.

In accordance with the invention, the fuel pump comprises a pressure chamber downstream of the work chamber of the pump, the pressure chamber communicating with the work chamber via an outlet pressure valve; a first connecting pipe extends in the pressure chamber for supplying fuel to a mixture former of the engine; the first connecting pipe extends into a lower region of the pressure chamber, and an open lower end of the connecting pipe is disposed in said lower region; a second connecting pipe is connecting to a fuel tank and communicates with the pressure chamber through a ball valve mounted in an upper region of the pressure chamber.

In a favorable and preferred embodiment, a bounding wall of the pressure chamber has a cavity which constitutes the lower region of the pressure chamber, said lower end of the first connecting pipe being located in said cavity.

Advantageously, the fuel pump comprises a cover to which the first connecting pipe and ball valve are secured.

A filter is disposed in the pressure chamber to surround the first connecting pipe so that it filters fuel flowing to the open end of the first connecting pipe. The fuel pump becomes extremely heated due to thermal conduction and radiation during hot idling operation and when starting a hot internal combustion engine, so that the fuel fed from the fuel tank is already vaporized upon entrance into the pump. This has heretofore had the result that the fuel was pushed back by the fuel vapor into the suction line, in the direction towards the fuel tank, resulting in a lengthy period of time without delivery of fuel until the commencement of liquid flow. Consequently, starting of the engine or application of load from the idling state becomes difficult if not impossible.

Sometimes the fuel vapor is forced in the direction of the mixture-former and could be conducted only in the separate gas separator into the fuel tank via a ball valve.

These deficiencies no longer occur in the pump of the invention, since its pressure chamber is used as a gas separator from which the fuel vapor which forms is returned directly to the fuel tank via a ball valve and a return line.

Another advantage of the construction of the fuel pump of the invention is that by the combination of two elements (pump and gas separator) into a single housing, considerable expense is saved while, on the other hand, no additional space is required in the engine compartment, which is already small.

The pump of the invention is cooled as rapidly as possible so that short starting times, good assumption of load and error-free hot operation can be obtained even with a further increase in the low-boiling fractions of the fuel or further reduction in the size of the engine compartment.

BRIEF DESCRIPTION OF THE DRAWING

One embodiment of the invention is diagrammatically shown in the sole figure of the drawing.

DETAILED DESCRIPTION OF A PREFERRED EMBODIMENT

In the drawing there is shown a fuel pump constructed as a diaphragm pump, although any other type of pump could be utilized without going beyond the scope of the invention. The pump comprises a housing 1, a cover 2 and a diaphragm 3 which is clamped between the housing 1 and the cover 2 and to which is fastened, by diaphragm plate 4, an operating rod 5 which is acted on by a spring 6 and is actuated in known manner by a cam (not shown) driven by an engine shaft.

A working chamber 8 is formed between a wall 7 of the cover 2 and the diaphragm 3 and chamber 8 is in communication with a pressure chamber 10 via a pressure valve 9 and with a fuel tank (not shown) via a suction valve 11, a suction connection 12 and a line 13.

The wall 7 of the pressure chamber 10 is formed with a recess or cavity 14 which extends into the working chamber 8. Into the cavity 14 extends a first connecting pipe 15 which is advantageously surrounded by a filter 16 in the pressure chamber 10. The pipe 15 is connected by a line 17 to a mixture-former (not shown) of the internal combustion engine. The distance from the open lower end 18 of the connecting pipe to the bottom of the cavity 14 is sufficient so that the resultant cross section of flow assures an adequate supply of fuel to the internal combustion engine during each phase of operation.

The cavity 14 is not absolutely necessay but it is advantageous in establishing a defined lowest region of the pressure chamber 10. In the absence of cavity 14, the lower end 18 of the connecting pipe 15 is then arranged at the lowest region in the installed position of the pump.

A ball valve 19 is mounted on the upper part of the cover 2 and the ball valve is positioned in the upper region of the pressure chamber 10. The ball valve 19 has a connection pipe 20 coupled to a line 21 connected as a return line to the fuel tank. A bypass 22 which bypasses a ball seat 23 of the ball valve 19 provides a continuous return flow of fuel into the pressure chamber 10.

The ball valve 19 operates in accordance with the suspended-body principle and therefore changes its flow rate as a result of the difference in density of the fluid, i.e., in the case of formation of gaseous vapor, the ball 24 descends and opens a large return cross section, while in the case of a liquid, the ball 24 rises and closes the passage by bearing against the seat 23 whereupon only the bypass 22 still remains for the continuous return of the fuel into chamber 10.

The pressure chamber 10 operates in the manner of a gas separator or a pre-container and any desired volume can be established depending on what is needed by the internal combustion engine which is to be supplied, for example, by simply increasing or reducing the height of the cover 2 or the diameter of the chamber.

While the invention has been disclosed in relation to a specific embodiment thereof, it will become apparent to those skilled in the art that numerous modifications and variations can be made within the scope and spirit of the invention as defined in the attached chaims.

What is claimed is:

1. In a fuel pump driven by an internal combustion engine and adapted for attachment thereto, the pump being provided with a work chamber having an inlet suction valve and an outlet pressure valve, the improvement comprising a pressure chamber downstream of the work chamber and in communication therewith via the outlet pressure valve, a first connecting pipe extending in said pressure chamber for supplying fuel to a mixture-former of the engine, said pressure chamber having upper and lower regions, said first connecting pipe having an open lower end disposed in said lower region of the pressure chamber, a second connecting pipe connected to a fuel tank, and a ball valve means in the upper region of said pressure chamber for controlling communication between said pressure chamber and said second connecting pipe, said ball valve means comprising a ball suspended in said upper region of said pressure chamber to rise and fall therein depending on the density of the fluid in the pressure chamber such that when gaseous vapor is formed in said pressure chamber said ball falls and said connecting pipe is opened in said pressure chamber whereas without gaseous vapor, the liquid fuel raises the ball to close communication between the connecting pipe and the pressure chamber.

2. The improvement as claimed in claim 1 wherein said pressure chamber includes a bounding wall having a cavity constituting the lower region of the pressure chamber, said lower end of the first connecting pipe being located in said cavity.

3. The improvement as claimed in claim 2 comprising a cover, said first connecting pipe being secured to said cover and projecting therefrom.

4. The improvement as claimed in claim 3 wherein said ball valve means is also secured to said cover.

5. The improvement as claimed in claim 4 wherein said second connecting pipe is secured to said ball valve means.

6. The improvement as claimed in claim 1 comprising a filter in said pressure chamber surrounding said first connecting pipe at said lower end thereof.

7. The improvement as claimed in claim 1 wherein said fuel pump comprises a diaphragm pump.

8. The improvement as claimed in claim 1 wherein said second connecting pipe has an open lower end disposed in said pressure chamber.

9. the improvement as claimed in claim 8 wherein said ball valve means comprises means for holding said ball in said pressure chamber in suspended relation in the fluid in said chamber below said open lower end of said second connecting pipe.

10. The improvement as claimed in claim 9 comprising a by-pass passage connecting said pressure chamber with said second connecting pipe to provide flow of fuel to said connecting pipe when said ball closes said open lower end of the second connecting pipe.

11. The improvement as claimed in claim 9 wherein said second connecting pipe extends vertically in said pressure chamber.

* * * * *